US009975721B2

(12) United States Patent
Nakayama

(10) Patent No.: US 9,975,721 B2
(45) Date of Patent: May 22, 2018

(54) CONVEYANCE DEVICE, PRINTER, AND CONVEYANCE METHOD

(71) Applicant: SEIKO EPSON CORPORATION, Tokyo (JP)

(72) Inventor: Hiroyuki Nakayama, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 16 days.

(21) Appl. No.: 14/304,190

(22) Filed: Jun. 13, 2014

(65) Prior Publication Data

US 2014/0374529 A1 Dec. 25, 2014

(30) Foreign Application Priority Data

Jun. 19, 2013 (JP) ..... 2013-128326

(51) Int. Cl.
*B65H 23/18* (2006.01)
*B65H 23/182* (2006.01)
(Continued)

(52) U.S. Cl.
CPC ..... *B65H 23/182* (2013.01); *B65H 23/042* (2013.01); *B65H 23/185* (2013.01);
(Continued)

(58) Field of Classification Search
CPC ..... B41J 15/005; B41J 15/16; B65H 2220/01; B65H 23/182; B65H 23/042; B65H 23/192; B65H 2301/4491; B65H 2301/4493; B65H 2404/143; B65H 2404/234; B65H 2408/214; B65H 2511/112; B65H 2513/11; B65H 2553/51; B65H 2801/15
See application file for complete search history.

(56) References Cited

U.S. PATENT DOCUMENTS 3,710,342 A * 1/1973 Highley, Jr. ..... G01D 15/24 242/417.3
4,062,025 A * 12/1977 Spence-Bate ..... G06K 1/14 156/108
(Continued)

FOREIGN PATENT DOCUMENTS

EP 0260882 A2 3/1988
EP 0264347 A2 4/1988
(Continued)

OTHER PUBLICATIONS

Extended European Search Report dated Mar. 5, 2015, corresponding to European patent application No. 14172646.3.

*Primary Examiner* — Michael E Gallion
(74) *Attorney, Agent, or Firm* — Hauptman Ham, LLP

(57) ABSTRACT

Provided is a conveyance device including a roll storage unit that stores a continuous sheet conveyance medium in a roll, a tractor that sequentially engages engaging parts in engagement holes formed along the length of the conveyance medium and conveys the conveyance medium stored in the roll storage unit, a roll drive unit that delivers the conveyance medium stored in the roll storage unit toward the tractor, a slack detection unit that detects slack in the conveyance medium between the roll storage unit and the tractor, and a control unit that controls the roll drive unit based on the detection value of the slack detection unit.

11 Claims, 4 Drawing Sheets

(51) Int. Cl.
*B65H 23/04* (2006.01)
*B65H 23/185* (2006.01)
*B65H 23/192* (2006.01)

(52) U.S. Cl.
CPC ... *B65H 23/192* (2013.01); *B65H 2301/4475* (2013.01); *B65H 2301/4491* (2013.01); *B65H 2301/4493* (2013.01); *B65H 2404/143* (2013.01); *B65H 2404/234* (2013.01); *B65H 2408/214* (2013.01); *B65H 2511/112* (2013.01); *B65H 2513/11* (2013.01); *B65H 2553/51* (2013.01); *B65H 2801/15* (2013.01)

(56) References Cited

U.S. PATENT DOCUMENTS 4,124,156 A * 11/1978 Waffner ..... B65H 23/1888 226/108
4,138,069 A * 2/1979 Bonzo ..... B65H 65/00 242/474.5
4,611,799 A * 9/1986 Nuttin ..... B41F 13/54 101/226
4,738,553 A * 4/1988 Uemura ..... B41J 29/42 347/181
4,753,380 A * 6/1988 Mitcham ..... B41J 15/16 226/74
4,805,111 A * 2/1989 Steidel ..... B65H 20/20 101/181
4,805,501 A 2/1989 Nuttin
4,896,808 A * 1/1990 Schaede ..... B41F 13/025 226/42
4,910,675 A * 3/1990 Burns ..... B65B 25/002 700/223
4,966,352 A 10/1990 Nuttin
4,995,745 A * 2/1991 Yokoi ..... B41J 11/48 226/143
5,006,887 A * 4/1991 Ogura ..... G03B 27/32 242/538.2
5,079,569 A * 1/1992 Bunch, Jr. ..... B41J 15/16 226/195
5,092,690 A * 3/1992 Grimm ..... B41J 11/48 226/196.1
5,189,470 A * 2/1993 Matsuda ..... G03G 15/2064 346/136
5,279,536 A * 1/1994 Abreu ..... B65H 45/1015 226/108
5,409,441 A * 4/1995 Muscoplat ..... B31B 41/00 493/220
5,533,719 A * 7/1996 Crowley ..... B65H 7/00 270/52.09
5,544,828 A * 8/1996 Winkler ..... B65H 67/0405 242/473.5
5,560,527 A * 10/1996 Meschi ..... B65H 23/042 226/118.1
5,768,959 A * 6/1998 Lorenzo ..... B26D 5/20 226/111
5,820,007 A * 10/1998 Crowley ..... B41J 11/0005 226/31
5,949,523 A * 9/1999 Adolphi ..... G03B 27/40 355/28
5,980,441 A * 11/1999 Kolbe ..... B31B 19/10 493/226
6,052,144 A * 4/2000 Reyner ..... B41J 11/46 347/136
6,285,854 B1 * 9/2001 Obata ..... B41J 15/005 399/384
6,536,337 B2 * 3/2003 Huchet ..... A01F 15/0715 100/76
2001/0035978 A1 * 11/2001 Sugaya ..... B41J 11/706 358/304
2005/0230448 A1 * 10/2005 Miura ..... B65H 20/20 226/101
2006/0055760 A1 * 3/2006 Cummins ..... B41J 3/01 347/104
2007/0039495 A1 * 2/2007 Sakamoto ..... B65H 20/02 101/228
2007/0146464 A1 * 6/2007 Shino ..... B41J 3/407 347/106
2009/0121065 A1 * 5/2009 Sato ..... B65H 18/103 242/364.11
2009/0128789 A1 * 5/2009 Sato ..... G03B 27/42 355/53
2011/0123203 A1 * 5/2011 Kikuchi ..... G03G 15/238 399/21
2011/0194861 A1 * 8/2011 Shiraishi ..... B65H 26/02 399/21
2011/0200378 A1 * 8/2011 Moriyama ..... B41J 11/30 400/583
2012/0087707 A1 * 4/2012 Igarashi ..... B41J 15/16 400/611
2014/0202295 A1 * 7/2014 Carson ..... B26D 7/0683 83/23

FOREIGN PATENT DOCUMENTS

JP 6-206652 A 7/1994
JP 10-35967 A 2/1998
JP 2002-293462 A 10/2002
JP 2002-348012 A 12/2002
JP 2012-56212 A 3/2012
JP 201245876 A 3/2012

* cited by examiner

CONVEYANCE DEVICE, PRINTER, AND CONVEYANCE METHOD

RELATED APPLICATION(S)

The instant application claims the benefit of Japanese patent application No. 2013-128326 filed Jun. 19, 2013, the entire disclosure of which is incorporated by reference herein.

BACKGROUND

1. Technical Field

The present disclosure relates to a device for conveying continuous sheet media stored in a roll.

2. Related Art

A device for conveying sheet media is typically used in printers and other devices for processing paper or other sheet media. Such conveyance devices commonly convey continuous sheet media stored in a roll, for example, by means of roller pairs that hold the medium from above and below.

The ability to convey the processed medium precisely is desirable in such conveyance devices, and particularly in conveyance devices used in printers, in order to enable high quality processing (such as printing) of the conveyed medium (such as paper), and many different designs have been proposed.

For example, maintaining a constant load on the upstream side, known as back tension (the tension from the upstream side), of the paper feed rollers (delivery rollers) that feed the conveyed medium to the processing position has been proposed. When the conveyed medium is stored in a roll, such as when roll paper is used, for example, one method uses a tension lever to buffer the heavy load from the conveyed medium stored in a roll.

As another example, configurations that reduce this back tension to zero also exist. More specifically, this configuration constantly produces slack in the conveyed medium on the upstream side of the paper feed rollers (delivery rollers).

JP-A-2012-45876 discloses a continuous-paper transportation mechanism including a paper feed roller and a tractor. During printing, the paper feed roller is intermittently driven at a speed enabling conveying the continuous paper at a second feed distance per unit time and the tractor is intermittently driven synchronously to the paper feed roller at a speed enabling conveying the continuous paper at a first feed distance that is less than the second feed distance per unit time.

According to some embodiments, a conveyance device comprises a roll storage unit, a roll drive unit, a tractor, a slack detection unit, and a control unit. The roll storage unit is configured to store a continuous sheet conveyance medium in a roll, the roll drive unit delivers the conveyance medium stored in the roll storage unit toward the tractor, the tractor is configured to sequentially engage engaging parts in engagement holes formed along the length of the conveyance medium and is configured to convey the conveyance medium, stored in the roll storage unit, the slack defection unit is configured to detect slack in the conveyance medium between the roll storage unit and the tractor, and the control unit is configured to control the roll drive unit based on the detection value of the slack detection unit.

In some embodiments, in a conveyance method of a conveyance device, which includes a roll storage unit, a tractor, a roll drive unit, a slack detection unit, and a control unit, the roll storage unit stores a continuous sheet conveyance medium on a roll, and the engaging parts of the tractor are sequentially engaged in holes formed in the conveyance medium. The conveyance medium is delivered toward the tractor, and slack in the conveyance medium between the roll storage unit and the tractor is detected, and the roll drive unit is controlled based on the slack detected in the conveyance medium.

Some embodiments include a printing device that has the conveyance device described above, the printing device being configured to execute a printing process on the conveyance medium.

According to some embodiments, in a conveyance method of a conveyance device having a roll storage unit configured to store a continuous sheet conveyance medium in a roll, a tractor is configured to sequentially engage engaging parts in engagement holes formed along the length of the conveyance medium and convey the conveyance medium stored in the roll storage unit, a roll drive unit is configured to deliver the conveyance medium stored in the roll storage unit toward the tractor, and a slack detection unit is configured to detect slack in the conveyance medium between the roll storage unit and the tractor, the control method being configured to control the roll drive unit based on the detection value of the slack detection unit.

In some embodiments, the control method repeatedly drives the roll drive unit and delivers the conveyance medium toward the tractor when the slack detection unit does not detect slack in the conveyance medium; and stops the roll drive unit when the slack detection unit detects slack in the conveyance medium.

DESCRIPTION OF EMBODIMENTS

In other approaches known to the inventors, when the conveyed medium is roll paper with a large diameter, must be conveyed intermittently at high speed, and maintain a constant back tension, the paper feed rollers (delivery rollers) start and stop frequently, and control that maintains constant back tension is difficult.

In addition to the other approaches mentioned above, in order to control the position of the conveyed medium, (paper) with no tension using the configuration that maintains zero back tension, guides must be provided on the left and right sides of the medium, and creases in the edges of the conveyed medium and skewing can easily occur.

When the load from the storage position of the conveyed medium is high, such as when the conveyed medium is a large diameter roll, the conveyed medium can also be damaged where the tractor pins engage the conveyed medium.

Compared to the approaches above, one or more embodiments provide a conveyance device in which one or more of the following effects are achieved.

Exemplary embodiments of the present disclosure are described below with reference to the accompanying drawings.

Figure 1:
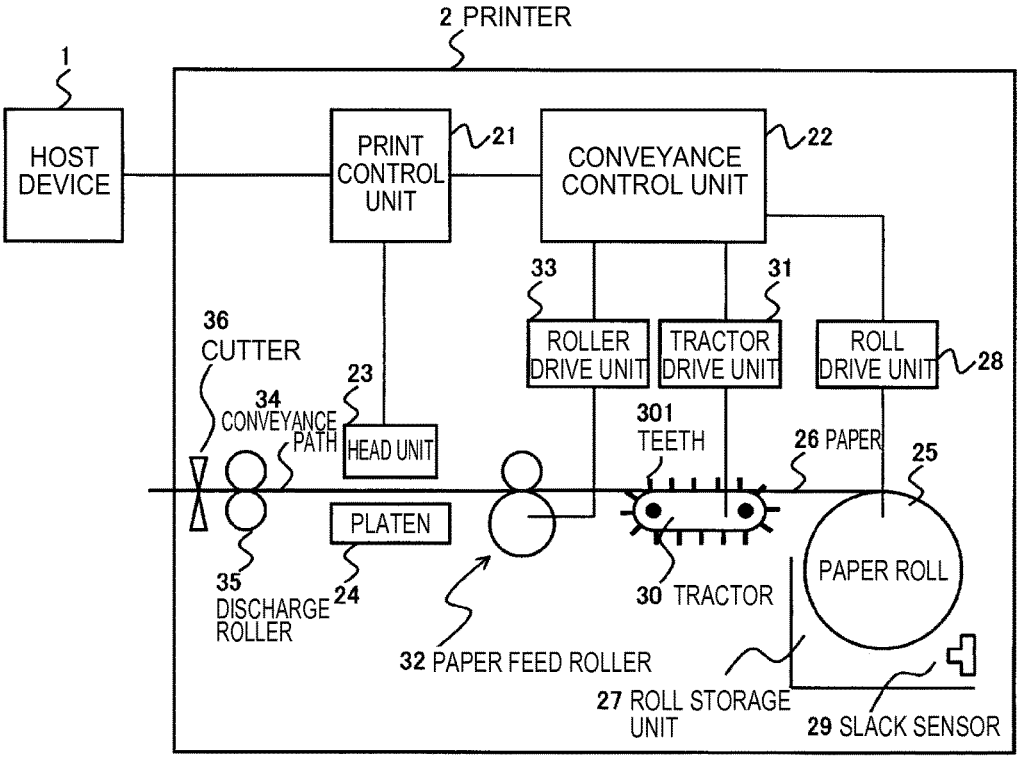
FIG. 1 is a block diagram of a printer with a conveyance mechanism according to at least one embodiment of the disclosure.

FIG. 1 is a view of a printer with a conveyance mechanism according to in accordance with one or more embodiments. The printer 2 shown in FIG. 1 is a printing device configured to convey paper 26 (as an example of a print medium stored as a paper roll 25) to the print position by means of a tractor 30 and a paper feed roller 32. By controlling the driving of the roll drive unit 28 based on a detected output from the slack sensor 29 during conveyance, the printer in one or more embodiments creates slack in the paper 26 on the upstream side of the tractor 30 and conveys the medium with high precision without damaging the conveyed medium.

As shown in FIG. 1, the printer 2 is a device that receives instructions from a computer or other host device 1 and executes a printing process, and in this example is a serial inkjet printer. The paper 26, which is continuous paper, is stored in a large diameter paper roll (paper roll 25) in the roll storage unit 27, and has multiple sprocket holes formed at an equal interval along both sides of the paper width. The paper 26 is conveyed intermittently at a relatively high speed during the printing process.

Printer 2 has a print system that controls the print content and applies a printing process to the paper 26, and a conveyance system that conveys the paper 26.

The print system includes the print control unit 21, and the print control unit 21 receives print instructions from the host device 1 and outputs print commands to the head unit 23, and outputs paper 26 conveyance commands to the conveyance control unit 22 of the conveyance system, according to the print instructions. The head unit 23 prints on the paper 26 positioned between the head unit 23 and platen 24 according to the print commands.

The conveyance operation of the conveyance system is executed until the paper 26, which is the print medium, is conveyed from the roll storage unit 27 through the conveyance path 34 to the head unit 23, and is then discharged through the discharge roller 35 from the printer 2.

In order to convey paper to the head unit 23, a paper feed roller 32 including a pair of rollers is disposed to the conveyance path 34 on the upstream side of the head unit 23 (FIG. 1). This pair of rollers is disposed at mutually opposing top and bottom positions with the paper 26 therebetween, the bottom roller being the drive roller and the top roller being the driven roller.

The drive roller is turned by the torque of a motor transferred through a speed reducing mechanism, and moves the paper 26 by means of the friction with the paper 26 held between the drive roller and the driven roller. When conveying the paper 26, the driven roller is held with pressure applied to the paper 26, and rotates in conjunction with rotation of the drive roller. In some embodiments the roller is finished with surface processing that reduces deformation and increases friction.

The speed reducer and motor that turn the drive roller comprise roller drive unit 33 shown in FIG. 1, which drives the drive roller as controlled by the conveyance control unit 22. A rotary encoder (not shown) is also disposed to the drive roller or the driven roller, and the conveyance control unit 22 controls the paper feed roller 32 based on the output signal from this rotary encoder.

The paper feed roller 32 handles conveying, that is, intermittently feeding as described above, the paper 26 during the printing process.

The tractor 30 is located on the upstream side of the paper feed roller 32, and includes teeth 301 (pins, engaging parts) that are inserted to and engage the sprocket holes in the paper 26, a tractor belt on the outside surface of which the teeth 301 are formed at a regular interval, and a drive sprocket and driven sprocket on which the tractor belt is mounted. The speed reducer and motor that turn the drive sprocket comprise the tractor drive unit 31 shown in FIG. 1, which drives the drive sprocket as controlled by the conveyance control unit 22.

The tractor 30 is driven, when conveying the leading end of the paper 26 to the position of the paper feed roller 32 when the paper roll 25 is set in the roll storage unit 27, for example. The tractor 30 also simply follows during intermittent conveyance in the printing process. When driven, the drive sprocket turns and rotates the tractor belt by the drive force of the motor in the tractor drive unit 31, sequentially engages the teeth 301 in the sprocket holes, and conveys the paper 26.

The paper roll 25 stored in the roll storage unit 27 can be turned on the center spindle by the roll drive unit 28. The roll storage unit 27 has a shaft member that passes through the spindle supporting the paper roll 25, and a pair of flanges disposed on opposite sides of the width of the paper roll 25. The roll drive unit 28 includes a motor that turns the shaft member of the roll storage unit 27, and a speed reducer that transfers drive power from the motor to the shaft member, and rotationally drives the shaft member as controlled by the conveyance control unit 22.

When the shaft member is turned by the roll drive unit 28, the paper roll 25 rotates on its spindle, and the paper 26 is conveyed to the tractor 30 side (downstream side). The paper roll 25 is rotationally driven by the roll drive unit 28 when the paper 26 is conveyed, and drive control is described more specifically below.

In FIG. 1, a cutter 36 is disposed at the downstream end of the conveyance path, and operates to cut the paper 26 when the printing process is finished.

The conveyance control unit 22 shown in FIG. 1 is the part that controls the conveyance system, and controls the paper 26 conveyance operation based on instructions from the print control unit 21. This control by the conveyance control unit 22 drives the foregoing paper feed roller 32, tractor 30, and roll drive unit 28 at specific times and conveys the paper 26. The printer 2 according to this embodiment is characterised by controlling the roll drive unit 28 based on the detection signal from the slack sensor 29.

While not shown in the figures, the conveyance control unit 22 has a CPU, ROM, RAM, and NVRAM (nonvolatile memory), and the process run by the conveyance control unit 22 is executed primarily by the CPU operating according to a program stored in ROM.

Note, further, that the conveyance system including the roll storage unit 27, roll drive unit 28, tractor 30, paper feed roller 32, and conveyance control unit 22 corresponds to the conveyance device according to some embodiments of the disclosure.

The printer 2 configured as described above is characterized by conveyance control of the paper 26, and particularly controlling rotation of the paper roll 25 by the roll drive unit 28.

Figure 2:
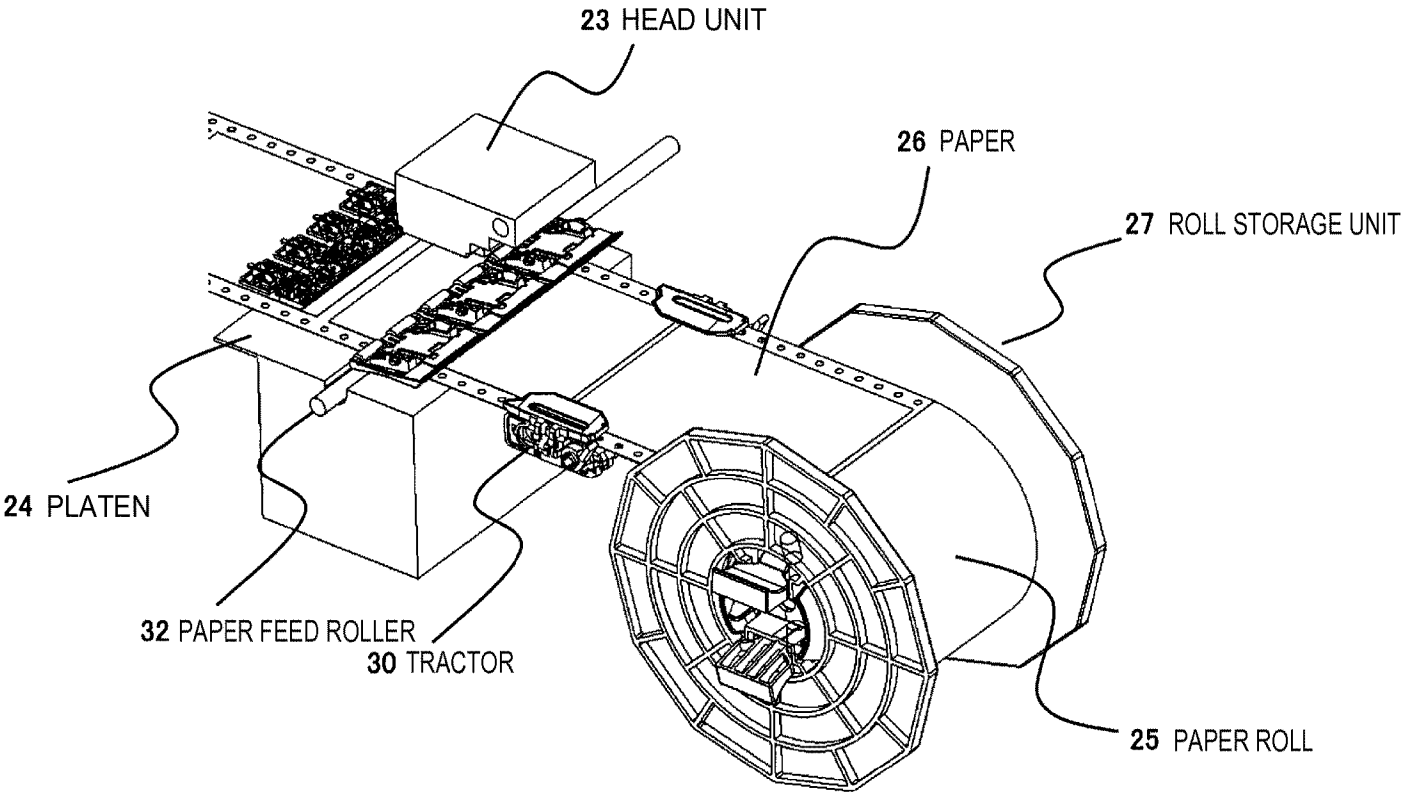
FIG. 2 is a perspective view of part of the printer 2 according to at least one embodiment.

FIG. 2 us a perspective view of part of the printer 2. Shown in FIG. 2 are the head unit 23 and platen 24 of the above printing system, and the roll storage unit 27, tractor 30, and paper feed roller 32 of the above conveyance system. As shown in FIG. 2, the tractor 30, paper feed roller 32, and head unit 23 are sequentially disposed sequentially in the downstream direction, and the paper 26 delivered from the paper roll 25 is conveyed through the tractor 30 from the paper feed roller 32 to the position of the head unit 23.

A slack sensor 29 (shown in FIG. 3) is also disposed where the paper roll 25 is stored (held). The slack sensor 29 is a sensor that detects slack in the paper 26 between the position where it is stored as paper roll 25 and the position of the tractor 30, and more specifically detects whether or not there is sufficient slack and outputs to the conveyance control unit 22. IN some embodiments, the slack sensor 29 determines that there is sufficient slack if the bottom end of the paper 26 stored (held) in the roll storage unit 27 is below a specific position, and determines that, there is not sufficient slack if this bottom end is above this specific position.

Figure 3:
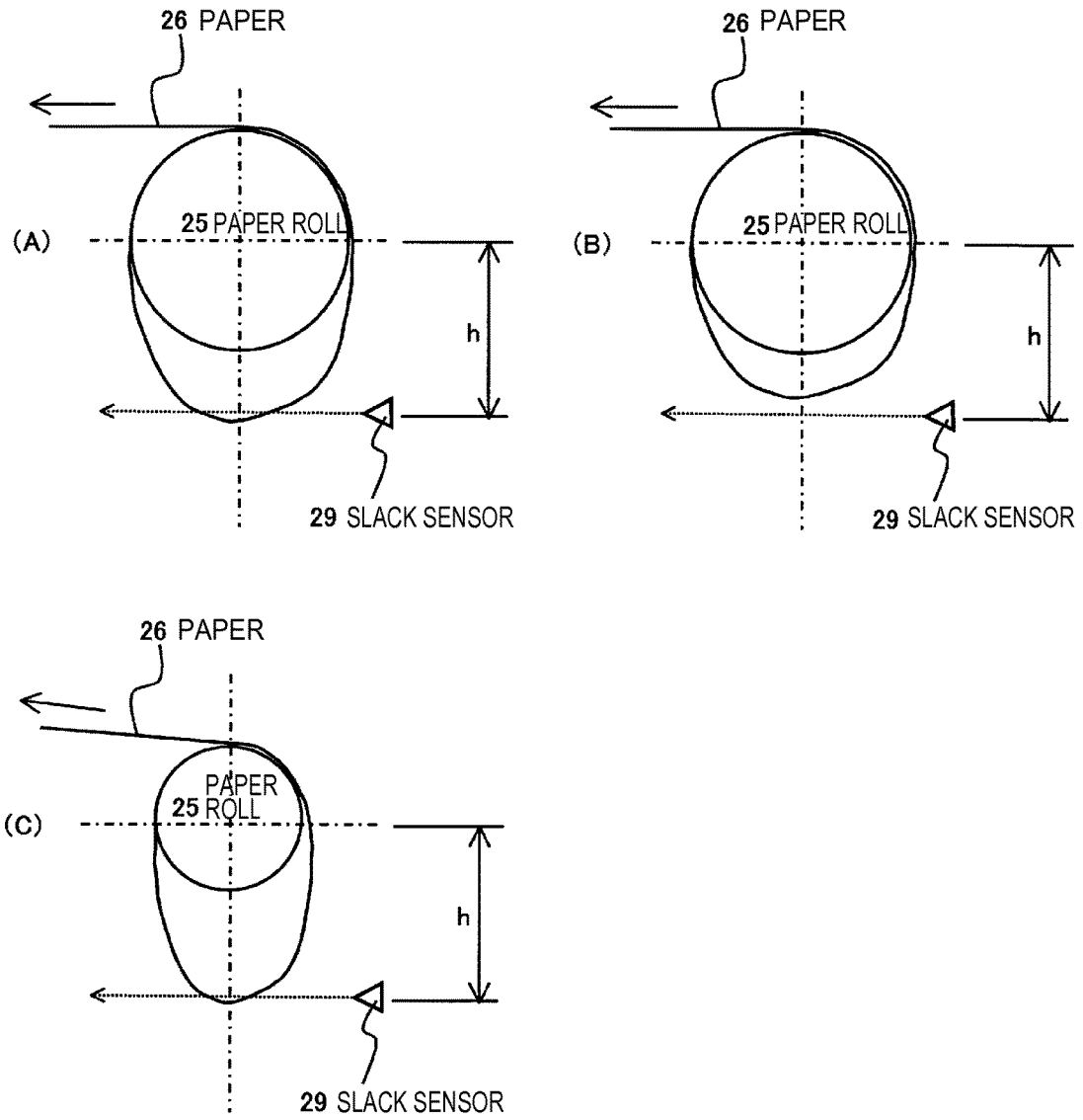
FIG. 3 is an example of slack detection by a slack sensor according to at least one embodiment.

FIG. 3 is used to describe slack detection by the slack sensor 29. The condition of the paper 26 and the paper roll 25 stored (held) in the roll storage unit 27 is illustrated in FIG. 3 where the arrows in the figures indicate the direction in which the paper 26 is delivered and conveyed. FIG. 3 (A) shows an example in which the remaining amount of paper 26 stored on the paper roll 25 is relatively great, and the slack is sufficient.

The slack sensor 29 detects if the paper 26 is present at a specific vertical position, and outputs an appropriate signal (ON signal) to the conveyance control unit 22 if the paper 26 is present. In the example shown in FIG. 3 (A), the bottom end of the paper 26 is below the position where the slack sensor 29 is disposed, and an ON signal indicating the paper 26 is present, that is, a signal indicating there is sufficient slack, is output. The vertical position of the slack sensor 29 is a distance h below the center axis of the stored paper roll 25, and this position is the above specific position for determining the position of the bottom of the paper 26.

Note that the slack sensor 29 could be a transmissive or reflective photosensor, a contact sensor, or other type of mechanical sensor.

FIG. 3 (B) shows an example in which the remaining amount of paper 26 stored in the paper roll 25 is relatively great, and the slack is not sufficient. In this event, the slack sensor 29 outputs to the conveyance control unit 22 a signal (OFF signal) indicating that the paper 26 is not present at the specific position, that is, a signal indicating there is not enough slack.

FIG. 3 (C) shows an example in which the remaining amount of paper 26 stored in the paper roll 25 is relatively small, and the slack is sufficient. In this event, the slack sensor 29 outputs an ON signal, that is, a signal indicating there is sufficient slack, as in the example shown in FIG. 3 (A).

In FIGS. 3 (A) and (B) and the example shown in FIG. 3 (C), the amount of slack that is determined to be sufficient increases as the amount of remaining paper 26 decreases, and distance h is set so that the amount of slack that is determined sufficient is appropriate even when a new paper roll 25 of the largest diameter is loaded. More specifically, when the ON signal is output based on the above decision, the amount of slack is sufficient regardless of how much paper 26 is left.

Figure 4:
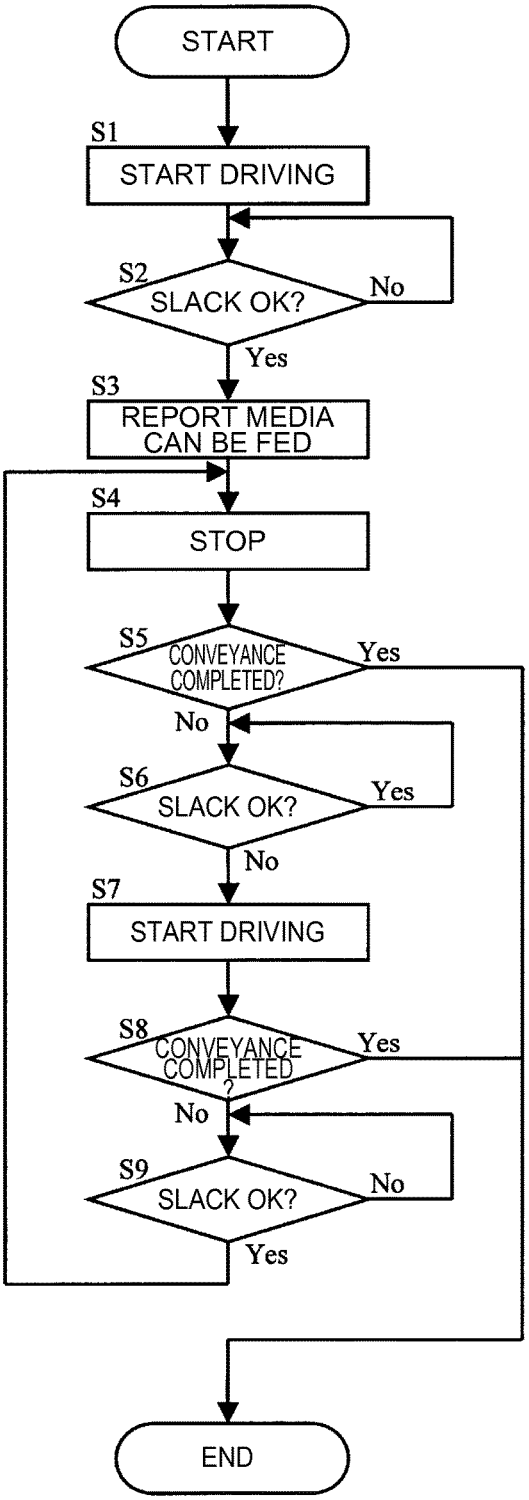
FIG. 4 is a flow chart describing control of a roll drive unit according to at least one embodiment.

FIG. 4 is a flow chart showing steps in the control of the roll drive unit 28. To start conveying the paper 26, the conveyance control unit 22 first instructs the roll drive unit 28 to start driving (step S1 in FIG. 4). The roll drive unit 28 then drives in response to the command, and the paper roll 25 turns in the direction in which the paper 26 is delivered downstream.

Thereafter, each time the signal output at a specific timing (at a specific time interval) from the slack sensor 29 is received, the conveyance control unit 22 determines based on the signal whether or not there is sufficient slack (step S2 in FIG. 4). In other words, the conveyance control unit 22 checks whether or not there is sufficient slack between the stored paper roll 25 and the tractor 30.

The conveyance control unit 22 continues driving the roll drive unit 28 until it is determined there is sufficient slack (until the above ON signal is received) (step S2 in FIG. 4 returns NO), and when sufficient slack is detected (step 32 in FIG. 4 returns YES), informs the part that controls other devices in the conveyance system that conveyance is possible (step S3 in FIG. 4). As a result of this report, driving the tractor 30 starts if media conveyance is immediately after paper roll 25 was loaded, and conveyance by the paper feed roller 32 starts if the leading end of the paper 26 has already been conveyed to a position downstream from the paper feed roller 32.

The conveyance control unit 22 outputs a stop command to the roll drive unit 28 after sending this report (step S4 in FIG. 4), driving the roll drive unit 28 therefore stops, and rotation of the paper roll 25 stops accordingly.

If the conveyance process has not ended (step S3 in FIG. 4 returns NO), the conveyance control unit 22 checks the slack as in step S2 (step S6 in FIG. 4). The conveyance control unit 22 keeps the roll drive unit 28 stopped (step S6 in FIG. 4 returns YES) until it determines there is not sufficient slack (until the above OFF signal is received), and when insufficient slack is detected (step S6 in FIG. 4 returns NO), instructs the roll drive unit 28 to start driving (step S7 in FIG. 4). The roll drive unit 28 then drives according to the instruction and the paper roll 25 turns in the direction delivering the paper 26 downstream. More specifically, the paper roll 25 turns in the direction of increasing slack.

If the conveyance process has not ended (step S8 in FIG. 4 returns NO), the conveyance control unit 22 checks the slack as in steps S2 and S6 (step S9 in FIG. 4). The conveyance control unit 22 continues driving the roll drive unit 28 until it determines there is sufficient slack (step S9 in FIG. 4 returns NO), and when sufficient slack is detected (step S9 in FIG. 4 returns YES), goes to step S4. More specifically, the conveyance control unit 22 outputs a stop command to the roll drive unit 28, the roll drive unit 28 stops driving, and rotation of the paper roll 25 stops accordingly.

These steps then repeat until the conveyance process is completed. When the conveyance process is completed (step S5 or S8 in FIG. 4 returns YES), the conveyance control unit 22 ends control of the roll drive unit 28 this time.

Control by the conveyance control unit 22 as described above causes the roll drive unit 28 to be driven and the paper roll 25 to turn in the direction of increasing slack when the paper 26 is being conveyed and there is not sufficient slack between the paper roll 25 and the tractor 30. By appropriately setting the amount of slack considered sufficient, slack can always be maintained in the paper 26 between the paper roll 25 and the tractor 30 while the paper 26 is being conveyed.

As described above, when conveying paper 26 with the printer 2 and conveyance system according to this embodiment, the roll, drive unit 28 is controlled so that there is slack in the paper 26 between the paper roll 25 and the tractor 30, and the load from the paper roll 25 is therefore not applied to the tractor 30, that is, the paper 26 will not be damaged where the tractor 30 and paper 26 engage due to back tension.

Furthermore, because the tractor 30 maintains constant back tension on the paper feed roller 32 due to the configuration of the paper feed roller 32 and tractor 30, the conveyance system according to this embodiment can maintain stable, precise paper feed control. In addition, the side to side position and direction of the paper 26 can be controlled and skewing and meandering can be minimised by the teeth 301 of the tractor 30 engaging the sprocket holes of the paper 26. The pressure of the paper feed roller can also be increased because the position of the paper 26 is firmly controlled by the tractor 30, media conveyance is therefore resistant to variations in load and other external factors, and stable conveyance is possible.

By maintaining sufficient slack in the paper 26 between the paper roll 25 and tractor 30 relative to the high speed, intermittent conveyance operation of the paper feed roller 32, and driving the roll drive unit 28 independently of other conveyance devices, starting and stopping rotationally driving the paper roll 25 can be controlled smoothly.

The printer 2 according to some embodiments can also print with high quality even during high speed serial printing using a large diameter paper roll because high precision conveyance of the paper is possible and there is no danger of damaging the paper.

The foregoing embodiment is described using paper as the print medium, but the disclosure is not so limited and can be used with any type of sheet medium.

The foregoing embodiments describe printing as the process applied to the conveyed sheet medium using a printer having the conveyance system of the disclosure, but the disclosure can be applied to various devices that process sheet media.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A conveyance device comprising:

a shaft member unit configured for supporting and driving a roll of a continuous sheet conveyance medium having a plurality of engagement holes formed along both sides of the conveyance medium;

a roll drive unit configured to drive the shaft member for delivering the conveyance medium from the roll;

a paper feed roller for conveying the conveyance medium delivered from the roll;

a tractor including a plurality of pins for engaging with the engagement holes of the conveyance medium between the roll and the paper feed roller;

a slack detection unit configured to detect a slack in the conveyance medium, the slack being between the roll and the paper feed roller and below the roll; and a control unit configured to control the roll drive unit based on a detection value of the slack detection unit, wherein the tractor is configured to drive the conveyance medium, and wherein while the conveyance medium is conveyed during intermittent conveyance in the printing process, the paper feed roller is controlled to drive, and the tractor is configured to follow the conveyance medium.

2. The conveyance device described in claim 1, wherein, when the slack detection unit does not detect the slack, the control unit controls the roll drive unit to drive the shaft member and is configured to deliver the conveyance medium toward the tractor.

3. The conveyance device described in claim 1, wherein:

when the slack detection unit detects the slack, the control unit controls the roll drive unit to stop.

4. The conveyance device described in claim 1, wherein:

the roll drive unit is configured to drive the shaft member independently of the paper feed roller.

5. The conveyance device described in claim 1, wherein:

at least one of the roll drive unit.

6. A printing device for printing on a conveyed medium, the printing device comprising:

the conveyance device described in claim 1.

7. A conveyance method of a conveyance device comprising a shaft member configured to support a roll of conveyance medium having a plurality of engagement holes formed along both sides of the conveyance medium, a paper feed roller, a tractor, and a roll drive unit configured to drive the shaft member, the method comprising:

delivering the conveyance medium toward the paper feed roller by driving the shaft member;

conveying the conveyance medium delivered from the roll by the paper feed roller;

engaging a plurality of pins of the tractor with the engagement holes of the conveyance medium between the roll and the paper feed roller;

detecting a slack in the conveyance medium, the slack being between the roll and the paper feed roller and being below the roll; and controlling the roll drive unit based on a result of a detection whether or not there is the slack, wherein the tractor is configured to drive the conveyance medium, and wherein while the conveyance medium is conveyed during intermittent conveyance in the printing process, controlling the paper feed roller to drive, and controlling the tractor to follow the conveyance medium.

8. The conveyance device of claim 1, wherein the control unit is configured to repeatedly drive the roll drive unit and deliver the conveyance medium toward the tractor when the slack detection unit does not detect slack in the conveyance medium; and the control unit is configured to stop the roll drive unit when the slack detection unit detects slack in the conveyance medium.

9. The conveyance device of claim 1, wherein the slack detection unit is positioned at a vertical distance below a center axis of the roll, and the slack detection unit is configured to output a first signal when a portion of the conveyance medium is detected to be at a vertical distance equal or greater than the distance from the slack detection unit to the center axis of the roll, and output a second signal when a portion of the conveyance medium is detected to be at a vertical distance less than the vertical distance from the slack detection unit to the center axis of the roll.

10. The conveyance device of claim 9, wherein upon receiving the second signal, the control unit is configured to drive the roll drive unit, and upon receiving the first signal, the control unit is configured to stop the driving of the roll drive unit.

11. The conveyance method of claim 7, further comprising:

sending a driving signal to the roll drive unit from a control unit, thereby causing the roll drive unit to start driving;

periodically outputting a detection result signal from the slack detection unit to the control unit indicating whether there is sufficient slack in the conveyance medium;

driving the roll drive unit until the slack detection unit outputs the detection result signal indicating sufficient slack;

outputting, by the control unit, a ready signal indicating that conveyance of the conveyance medium is possible; and outputting, by the control unit, a stop command signal to the roll drive unit.

* * * * *